United States Patent [19]

Berve

[11] 3,946,907

[45] Mar. 30, 1976

[54] VACUUM SEALING FOR THE DISCHARGE NOZZLE OF A CASTING LADLE SERVING AS A VACUUM CONTAINER

[75] Inventor: Jürgen Berve, Bochum, Germany

[73] Assignee: Fried. Krupp Hüttenwerke AG, Bochum, Germany

[22] Filed: Oct. 23, 1974

[21] Appl. No.: 517,261

[30] Foreign Application Priority Data

Nov. 2, 1973 Germany ..... 7339191[U]

[52] U.S. Cl. ..... 222/152; 164/61; 164/253; 222/541; 222/561

[51] Int. Cl.[2] ..... B22D 37/00; B22D 41/08

[58] Field of Search ..... 164/61–68, 164/253–259; 222/152, 561, 541

[56] References Cited

UNITED STATES PATENTS

| | | | |
|---|---|---|---|
| 2,328,267 | 8/1943 | Freeman | 222/152 UX |
| 3,146,503 | 9/1964 | Sickbert | 222/152 |

*Primary Examiner*—Robert B. Reeves
*Assistant Examiner*—David A. Scherbel
*Attorney, Agent, or Firm*—Burgess, Dinklage & Sprung

[57] ABSTRACT

A vacuum sealing for the discharge nozzle of a casting ladle as for liquid steel is disclosed. The vacuum sealing, which prevents the penetration of atmospheric gases through the porous refractory discharge nozzle, is arranged in a vacuum-tight manner below the discharge nozzle. The vacuum sealing consists of clingy plastic films or thin metal sheets.

4 Claims, 3 Drawing Figures

VACUUM SEALING FOR THE DISCHARGE NOZZLE OF A CASTING LADLE SERVING AS A VACUUM CONTAINER

BACKGROUND OF THE INVENTION

1. Field of the Invention

This invention is directed to degassing devices for liquid steel. More specifically the invention is directed to degassing by vacuum in a casting ladle sealed by a lid. In this it should be noted that apart from the vacuum-sealed lid the discharge nozzle for pouring the steel at the floor of the casting ladle should also be sealed vacuum-tight. This is especially important for processes in which the steel to be treated runs into the casting ladle under vacuum and the steel running in is to be subjected to the effect of the vacuum from the beginning. Whether it is a stopper control or a sliding nozzle, a discharge nozzle which is not completely sealed means a leak which prevents the deep vacuum desired initially and during treatment.

2. Discussion of the Prior Art

It has been suggested that the casting ladle is sealed vacuum-tight in a stopper rod control or in a slide nozzle by metal hoods arranged under the ladle base completely covering the discharge nozzle. These metal hoods, which have to be constructed detachably especially in a sliding nozzle, mean an expensive construction and are hard to manipulate. The invention has therefore set the object of developing a vacuum sealing which is easily manipulated and cheaply produced.

SUMMARY OF THE INVENTION

The object is solved according to the invention in that the outer end of the refractory discharge nozzle is covered by a vacuum-tight sealing. This sealing can, for example, consist of a clingy plastic or aluminium film. When producing the vacuum this film lies vacuum-tight against the refractory discharge nozzle which is pervious to gas, so that a vacuum-tight seal is guaranteed. While maintaining the vacuum the film gives adequate protection and when casting it can easily be destroyed by mechanical or thermal action so that a simple manipulation is possible.

In a preferred embodiment which is especially suitable for a stopper rod control the outer end of the discharge nozzle is surrounded at a distance by two rings concentric to another, of which one is fixed gas-tight to the ladle base so that the film can be clamped vacuum-tight between the two rings. It is expedient to arrange a gas-pervious support between the film and the refractory discharge nozzle so that the film is not directly adjacent to the hot discharge nozzle.

With a vacuum container provided with a sliding nozzle an arrangement is preferred in which the sealing is arranged between the sliding plate and the discharge nozzle. The strength of this nozzle is chosen so that on the one hand the vacuum-tight sealing is guaranteed and on the other hand the sealing plate can be destroyed without difficulty, and in that the function of the sliding nozzle is not impaired by this destruction. Sealings which can be destroyed mechanically and / or thermally are, for example, thin fillets or foils of metals, especially easily smeltable metal. Preferably the sealing consists of aluminium, and for this a strength of between 0.3 and 1 mm has proved to be particularly suitable. The diameter of the sealing is expediently chosen large enough for the sealing to reach at least as far as the mounting plate of the sliding shutter. In this case a particularly tight sealing is guaranteed as all refractory components of the discharge nozzle are sealed on the outside by vacuum-tight parts, be they the mounting plate or the sealing itself. To further improve the sealing it can be expedient to apply a thin layer of sealing substance, e.g. vacuum putty, onto the sealing film, whereby rough surfaces can be better eliminated.

The construction of the sealing is very simple, as a plate-like sealing only has to be slid between the vacuum ladle unit and the sliding nozzle unit. After the assembly of sliding nozzle and ladle it is expedient to fill the discharge nozzle with sand so that the sliding nozzle is better protected from the hot steel melt until casting. Apart from metal a smeltable or vapourisable plastic which can be destroyed after opening the sliding plate from below can be used as a material for the sealing.

BRIEF DESCRIPTION OF THE DRAWINGS

The invention is described in more detail as follows by means of two exemplified embodiments. They show.

DESCRIPTION OF THE PREFERED EMBODIMENT

Figure 1:
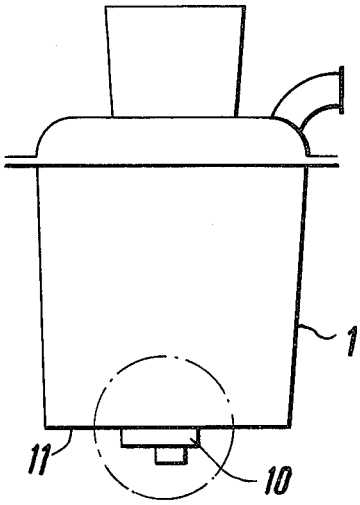
FIG. 1 a casting ladle used as a vacuum container shown in side section.
Figure 2:
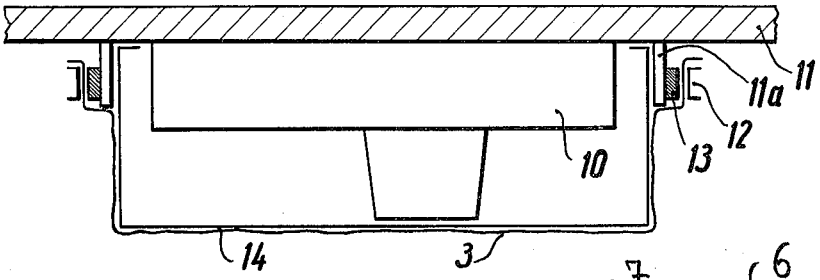
FIG. 2 an enlarged view of a first exemplified embodiment of the vacuum sealing with a ladle shutter, FIG. 3 a further exemplified embodiment of the vacuum sealing which is particularly suitable for a sliding nozzle.

In FIG. 1 is shown a conventional casting ladle which serves as a vacuum container for liquid steel. On the ladle base 11 of the casting ladle 1 is disposed a discharge nozzle 7 which is sealed by a sliding nozzle 10. As FIG. 2 shows according to the invention this nozzle 7 is sealed from outside by means of a clingy vacuum-tight film 3 which in a vacuum lies against the support box 14. The film 3 is tensioned between rings 12, 13 concentric to one another, the inner ring 13 being connected fast and vacuum-tight to the ladle base 11 by a ring 11*a*. The support box 14 only serves as a range spacer so that the film 3 can not lie against the hot sliding nozzle 10. The support box 14 can consist of, for example, a light metal grid so that a good manipulation can be guaranteed.

Figure 3:
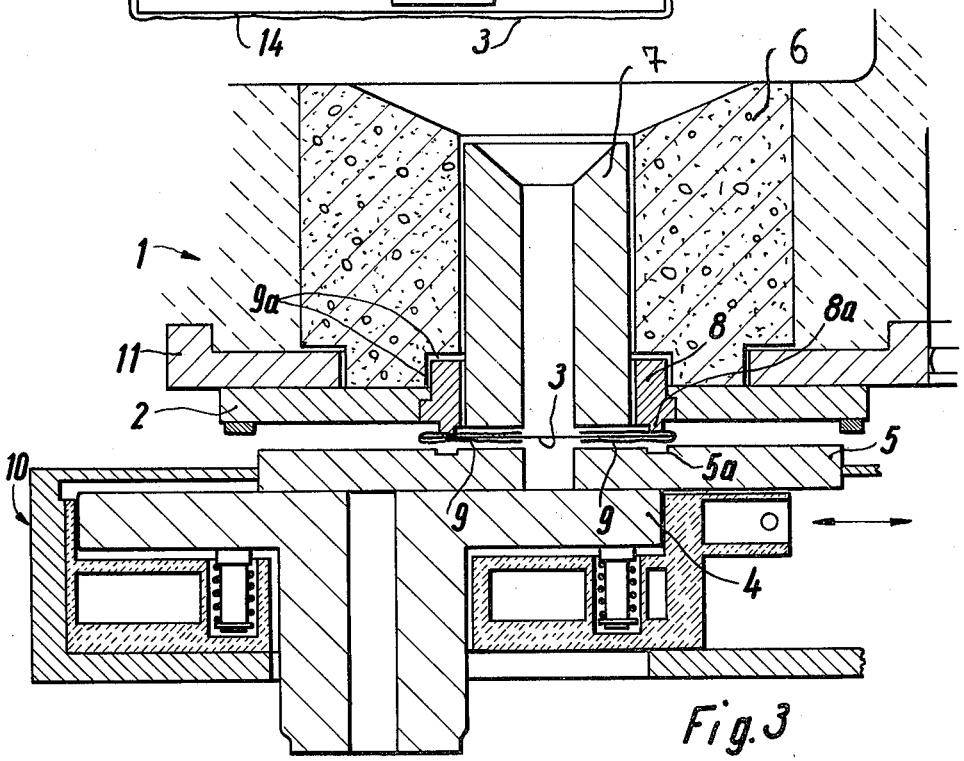

The exemplified embodiment shown in FIG. 3 has given particularly good results for sliding nozzles. For better understanding in FIG. 3 the unit vacuum ladle 1 or base plate 11 and the unit sliding nozzle 10 have been shown slightly spaced apart. The sealing is arranged between these two units, preferably an aluminium foil having a strength of 0.5 mm being used as a sealing material. The sealing 3 is preferably provided with a sealing substance, e.g. vacuum putty, Terostat, firm Teroson, Heidelberg, in the edge regions. The sliding nozzle 10 consists of the sliding plate 4 and the head plate 5. On the base plate 11 of the vacuum ladle 1 is fixed the mounting plate 2 of steel. The mounting plate supports the refractory perforated brick 6 and surrounds the refractory discharge nozzle 7. The lower end of the discharge nozzle is concentrically surrounded by the outer shell 8.

In order to achieve better sealing it can be expedient to apply additional vacuum-tight putty 9 onto the contact surfaces between the outer shell 8, the discharge nozzle 7 and the perforated brick 6. This occurs preferably by applying e.g. painting, a putty onto the contact surfaces. At the lower end of the outer shell 8 is arranged a spring 8*a* which engages in a corresponding groove 5*a* in the head plate 5. On assembly the sealing 3 provided with putty 9 presses against the lower end of the discharge nozzle 7 and the outer shell 8 and into the groove — spring arrangement 8*a*, 5*a*, whereby the refractory materials are closed vacuum-tight to the outside. Subsequently sand is put into the discharge nozzle 7, and the vacuum can be prodiced without air from outside penetrating into the vacuum ladle 1.

With a discharge nozzle 7 filled with sand and a seal 3 of aluminium foil the sealing 3 is thermally protected by the sand against the hot steel. In this case after opening the sliding plate 4 the sealing 3 has to be opened (destroyed) from below by pushing or by the effect of heat. Then the sand and subsequently the degasified steel flows through the sliding nozzle 10.

I claim:

1. Vacuum sealing for the discharge nozzle of a casting ladle serving as a vacuum container, said vacuum container being provided with a discharge nozzle 7 and a shutter 10 comprising a head plate 5 and a sliding plate 4; said vacuum sealing comprising a gasket arranged between the head plate 5 and the discharge nozzle 7; and wherein said gasket can be destroyed mechanically at the beginning of the casting.

2. Vacuum sealing according to claim 1, characterised in that the sealing (3) is arranged between the head plate (5) of the sliding nozzle (10) and the mounting plate (2) surrounding and supporting the discharge nozzle(7).

3. Vacuum sealing according to claim 1, characterised in that the sealing(3) consista of aluminium foil.

4. Vacuum sealing for the discharge nozzle of a casting ladle serving as a vacuum container, said vacuum container being provided with a discharge nozzle 7 and a shutter 10 comprising a head plate 5 and a sliding plate 4; said vacuum sealing comprising a gasket arranged between the head plate 5 and the discharge nozzle 7; and wherein said gasket can be destroyed thermally at the beginning of the casting.

* * * * *